US009982933B2

(12) United States Patent
Choo

(10) Patent No.: US 9,982,933 B2
(45) **Date of Patent: *May 29, 2018**

(54) ICE BIN AND METHOD OF TRANSFERRING ICE USING THE SAME

(71) Applicant: Dongbu Daewoo Electronics Corporation, Seoul (KR)

(72) Inventor: Gwang Ho Choo, Gwangju (KR)

(73) Assignee: Dongbu Daewoo Electronics Corporation, Seoul (KR)

( * ) Notice: Subject to any disclaimer, the term of this patent is extended or adjusted under 35 U.S.C. 154(b) by 580 days.

This patent is subject to a terminal disclaimer.

(21) Appl. No.: 14/106,640

(22) Filed: Dec. 13, 2013

(65) Prior Publication Data

US 2015/0135738 A1 May 21, 2015

(30) Foreign Application Priority Data

Nov. 21, 2013 (KR) ..... 10-2013-0141923

(51) Int. Cl.

| | |
|---|---|
| ***F25C 5/02*** | (2006.01) |
| ***F25C 5/18*** | (2018.01) |
| ***F25C 1/00*** | (2006.01) |
| ***F25C 5/04*** | (2006.01) |

(52) U.S. Cl.

CPC ..... *F25C 5/20* (2018.01); *F25C 5/046* (2013.01); *F25C 5/18* (2013.01); *F25C 5/182* (2013.01)

(58) Field of Classification Search

CPC .. F25C 5/02; F25C 5/046; F25C 5/182; F25C 5/007; F25C 5/005; F25C 5/18; F25C 2400/10; F25C 2700/10

USPC ..... 62/66, 320, 344

See application file for complete search history.

(56) References Cited

U.S. PATENT DOCUMENTS

| | | | | |
|---|---|---|---|---|
| 4,930,685 | A | 6/1990 | Landers | |
| 4,972,999 | A * | 11/1990 | Grace ..... | F25C 5/046 241/101.1 |
| 5,104,007 | A | 4/1992 | Utter | |
| 2008/0156826 | A1 | 7/2008 | Kim et al. | |
| 2011/0120152 | A1 | 5/2011 | Talegaonkar et al. | |

FOREIGN PATENT DOCUMENTS

| | | | |
|---|---|---|---|
| CN | 131453 | A | 9/2006 |
| CN | 101300456 | B | 9/2012 |
| EP | 2613108 | | 7/2013 |
| KR | 10-0820816 | | 4/2008 |
| KR | 10-2009-0013540 | A | 2/2009 |
| WO | 2007028029 | | 3/2007 |
| WO | 2004147045 | | 12/2008 |

OTHER PUBLICATIONS

Yang, Young Joo; Refrigerator Ice Maker for Improving Ice Making Efficiency; Abstract of KR 10-2009-0013540; Feb. 5, 2009; http://kpa.kipris.or.kr.

* cited by examiner

*Primary Examiner* — Frantz Jules
*Assistant Examiner* — Steve Tanenbaum

(57) ABSTRACT

An ice bin and a method of transferring ice using the same include a case having an upper portion configured to store ice produced by an ice maker, and a dispensing port at one side of a lower end of the case configured to dispense ice to the outside; a transferring unit that transfers ice from a lower portion of the case to the upper portion of the case; and a crushing unit configured to crush ice transferred by the transferring unit, and discharge the crushed ice to the dispensing port.

19 Claims, 11 Drawing Sheets

ICE BIN AND METHOD OF TRANSFERRING ICE USING THE SAME

CROSS-REFERENCE TO RELATED APPLICATIONS

This application is based on and claims priority from Korean Patent Application No. 10-2013-0141923, filed on Nov. 21, 2013, the disclosure of which is incorporated herein in its entirety by reference.

TECHNICAL FIELD

The present disclosure relates to an ice bin and a method of transferring ice using the same, and more particularly, to an ice bin at a door side of the refrigerator to efficiently utilize an inner space of the refrigerator, and a method of transferring ice using the same.

BACKGROUND

The refrigerator refers to an apparatus that is used for the purpose of storing and maintaining freshness of food for a long period of time. The refrigerator has a food storage chamber configured to maintain low temperature by a refrigeration cycle for maintaining freshness of food.

In consideration of the different types, characteristics, storage periods, and the like of food, a plurality of storage chambers in a refrigerator may have different characteristics, so that a user may select a suitable storage method for the food. The representative storage chambers include a refrigerator chamber and a freezer.

The refrigerator chamber maintains a temperature of approximately 3° C. to 4° C. to store food and vegetables and maintain freshness of food for a long period of time. The freezer stores frozen food in a frozen state for a long period of time, and maintains a below-zero temperature to maintain the quality of frozen food, and to make and store ice.

In recent years, the refrigerator has been developed to perform various functions in addition to the aforementioned traditional functions of the refrigerator. For example, in the related art, to enjoy cool water from the refrigerator, a user needs to open the door and take out a bottle of water stored in the refrigerator chamber. However, in recent years, a refrigerator has been developed to include a dispenser outside the door, supplied with water cooled by cold air in the refrigerator chamber, so that the user may obtain cool water without opening the door. Refrigerators having a dispenser with an additional function of purifying water have also be developed.

When a user intends to drink a beverage or water with ice, the user may need to open a freezer door and remove the ice stored in an ice tray in the freezer.

However, it is inconvenient in that the user needs to open the door, take out the ice tray, and thereafter, separate the ice from the ice tray. When the door of the freezer is opened, cold air in the freezer escapes to the outside, which increases the temperature in the freezer. Accordingly, the compressor performs additional work, and thus, energy may be wasted.

Therefore, an ice maker is suggested to supply ice from the freezer to an outside of the refrigerator without opening the door.

As illustrated in FIG. 1, the freezer F includes an ice maker 1 at an inner upper portion of the freezer F, configured to make ice using cold air in the freezer F, an ice bin 2 in the freezer F, separates from the ice maker 1 and configured to store ice made by the ice maker, a dispenser 4 on the freezer door 3, that dispenses ice to the outside without opening and/or closing the freezer door 3, and an ice chute 5 that guides the ice in the ice bin 2 to the dispenser 4.

However, a capacity of the freezer F decreases due to the volume of the ice maker 1. Since the ice maker 1 has a heavy weight (e.g., including the weight of a motor that drive the ice maker and the ice bin), it is inconvenient to disassemble and/or transfer the ice bin for other uses and/or clearing.

A conventional refrigerator may be disclosed in Korean Patent Application Laid-Open No. 10-2009-0013540 (Feb. 5, 2008).

SUMMARY

The present disclosure has been made in an effort to provide an ice bin, in which a compact ice maker is at or on a refrigerator door, and the ice bin may be detachable from the door, and a method of transferring ice using the same.

A technical object to be achieved in the present disclosure is not limited to the aforementioned technical objects, and other unmentioned technical objects will be obviously understood from the description below by those skilled in the technical field to which the present disclosure pertains.

Embodiments of the present disclosure provide an ice bin including a case having an upper portion to store and/or accommodate ice produced by an ice maker, and a dispensing port at one side and/or a lower end or surface of the case, configured to dispense the ice to the outside; a transferring unit that transfers the ice from a lower portion of the case to the upper portion of the case; and a crushing unit that crushes the ice from the transferring unit, and discharges the crushed ice to the dispensing port.

The ice bin may further include a partition and/or wall in the case, configured to divide into a storage space and a transferring space. A supply port is at a lower side of the partition wall unit, configured to supply the stored ice to the transferring unit.

Another side and/or lower end or surface of the case may be inclined downwardly (e.g., declined) toward the transferring unit.

The transferring unit may include a plurality of guide ribs that rotate along an outer surface of the crushing unit.

The transferring unit may further include accommodating ribs (e.g., ice accommodating ribs), each of which is at a side and/or end of one of the plurality of guide ribs. Alternatively, the transferring unit may further include an accommodating rib that is attached to and that completely surrounds the plurality of guide ribs.

The transferring unit may further include a first plate at an one edge of the crushing unit, and connected to one end of each of the plurality of guide ribs; and a second plate on another end of the crushing unit, and connected to another end of each of the plurality of guide ribs.

The plurality of guide ribs, the accommodating ribs, the first plate, and the second plate may be integral with each other.

The crushing unit may include a housing in the transferring unit, having an inlet port at an upper side of the housing, configured to transfer ice to the transferring unit; and a rotatable crushing blade in the housing, configured to crush ice.

The crushing unit may further include a cover configured to open and close an outlet port at a lower side and/or surface of the housing, so that the housing may communicate with the dispensing port.

The ice bin may further include a drive unit (e.g., motor) at one side of the housing, configured to provide driving force to a rotation shaft of the transferring unit and the crushing blade.

Embodiments of the present disclosure provide a method of transferring ice using an ice bin, including transferring ice produced in an ice maker to the ice bin; supplying the ice stored in a case of the ice bin to a transferring unit along an inclined surface at a lower end and/or surface of the case; transferring the ice from the transferring unit to a crushing unit; crushing the ice in the crushing unit; and discharging crushed ice through a dispenser.

In the process of transferring ice, ice may be guided by a plurality of guide ribs that rotates along an outer surface of the crushing unit, and placed in an inlet port at an upper side of the crushing unit.

The accommodating ribs on side ends of the plurality of guide ribs prevent ice from deviating from the transfer path in the transferring unit while the ice is transferred to the crushing unit.

The plurality of guide ribs may rotate in multiple directions (e.g., forward and backward).

According to the exemplary embodiments of the present disclosure, the compact ice maker is on and/or in the exterior surface of the refrigerator door, so that a storage space in the refrigerator may be efficiently utilized, and the ice bin may be easily detachable from the door for other uses and for cleaning.

The foregoing summary is illustrative only and is not intended to be in any way limiting. In addition to the illustrative aspects, embodiments, and features described above, further aspects, embodiments, and features will become apparent by reference to the drawings and the following detailed description.

DETAILED DESCRIPTION

Figure 1:
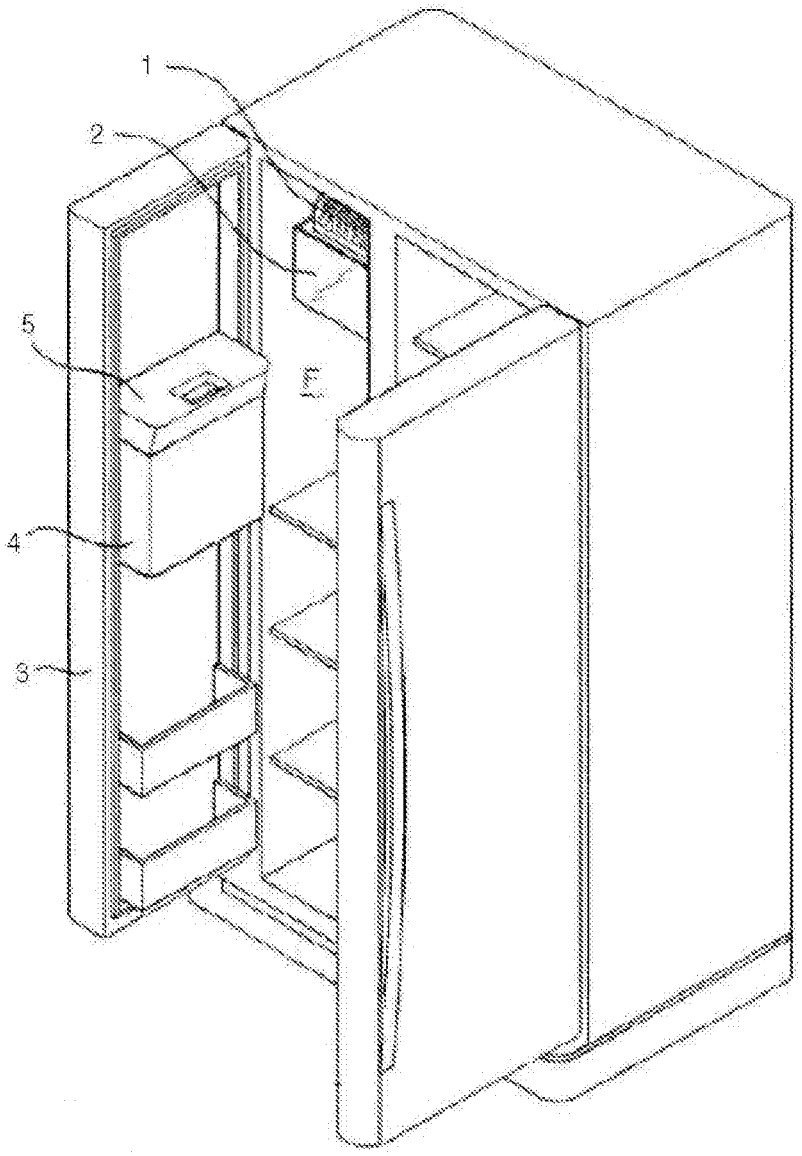
FIG. 1 is a perspective view illustrating a refrigerator in the related art.

In the following detailed description, reference is made to the accompanying drawing, which form a part hereof. The illustrative embodiments described in the detailed description, drawing, and claims are not meant to be limiting. Other embodiments may be utilized, and other changes may be made, without departing from the spirit or scope of the subject matter presented here.

Hereinafter, one or more exemplary embodiments according to the present disclosure will be described in detail with reference to the accompanying drawings. In this process, sizes or shapes of constituent elements illustrated in the drawings, and the like may be exaggerated for clarity and ease of description. The terms, which are specially defined in consideration of configurations and operations of the present disclosure, may vary depending on the intention or usual practice of a user or an operator. These terms should be defined based on the content throughout the present specification. The spirit of the present disclosure is not limited to suggested exemplary embodiment(s) of the present disclosure, and those skilled in the art who understand the spirit of the present disclosure may easily carry out other exemplary embodiments within the scope of the same spirit. Of course, other exemplary embodiments also belong to the scope of the present disclosure.

Figure 2:
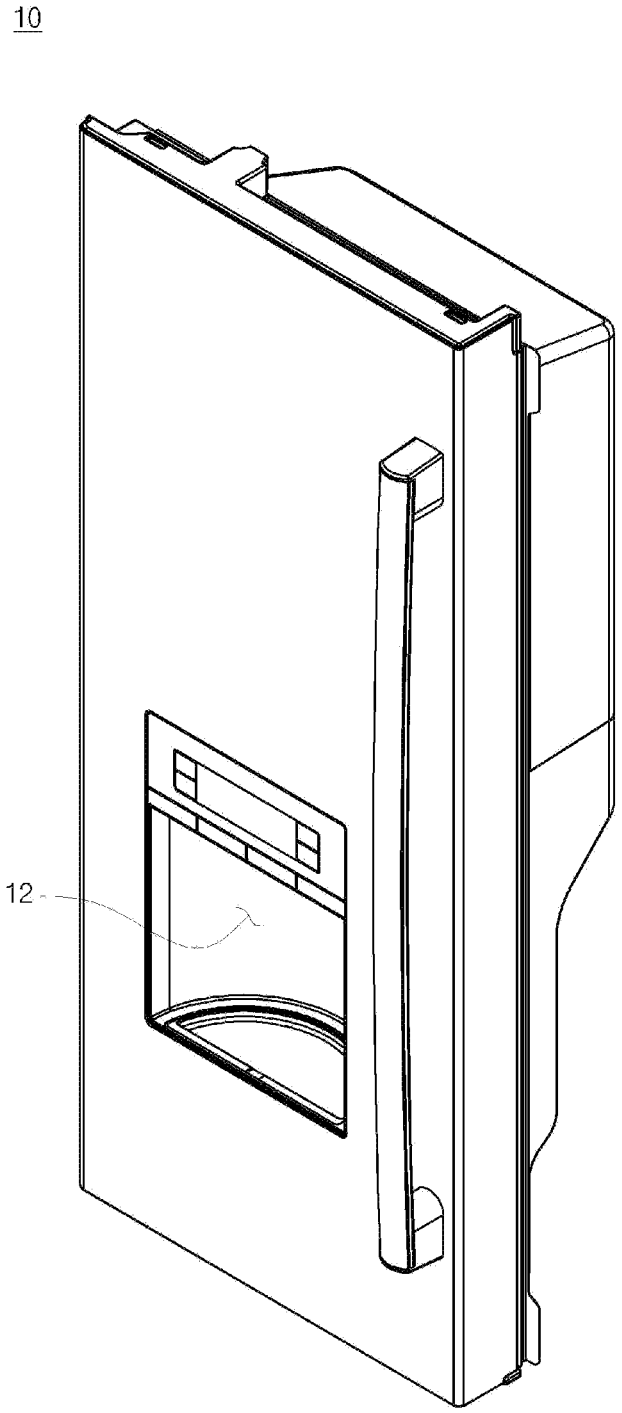
FIG. 2 is a perspective view illustrating an exemplary exterior portion of a refrigerator door according to embodiments of the present disclosure.
Figure 3:
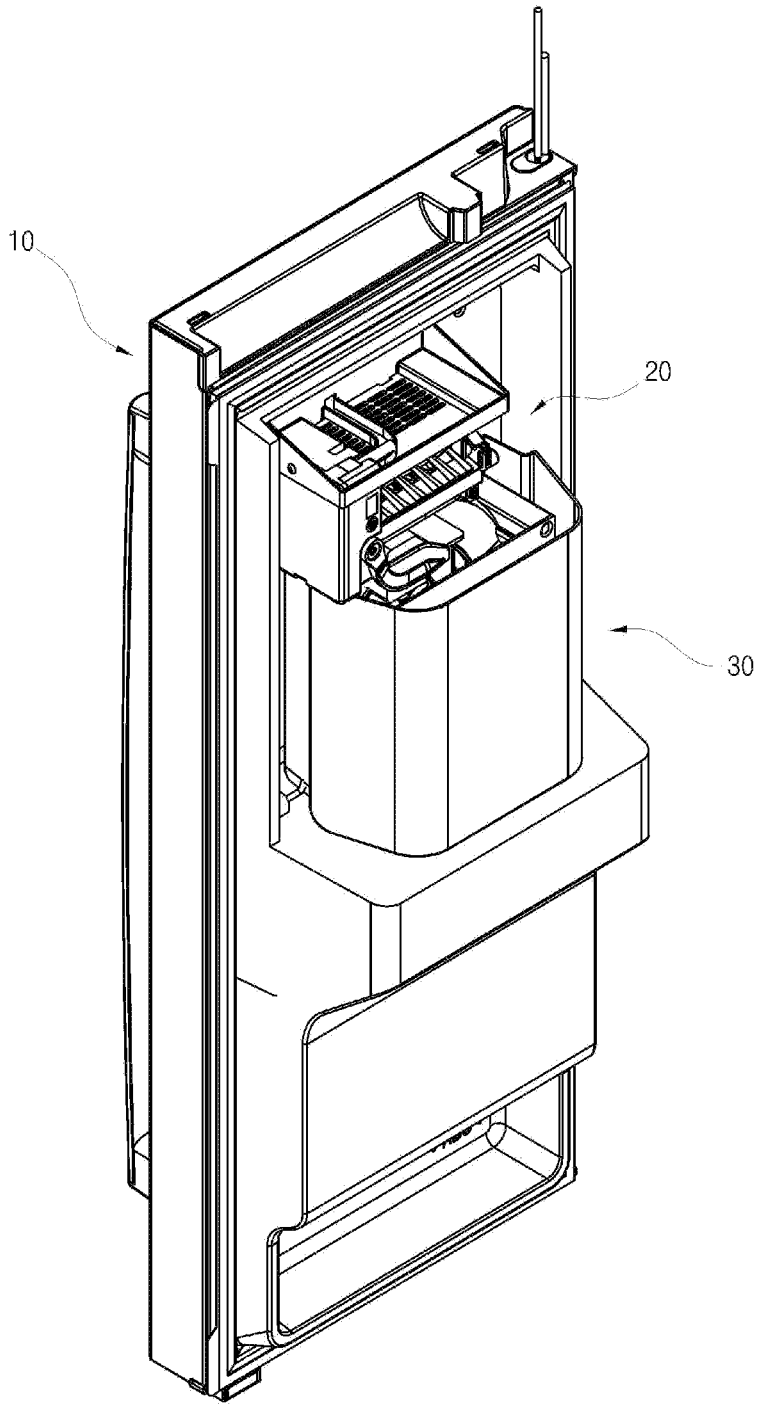
FIG. 3 is a perspective view illustrating an exemplary interior portion of the refrigerator door according to embodiments of the present disclosure.
Figure 4:
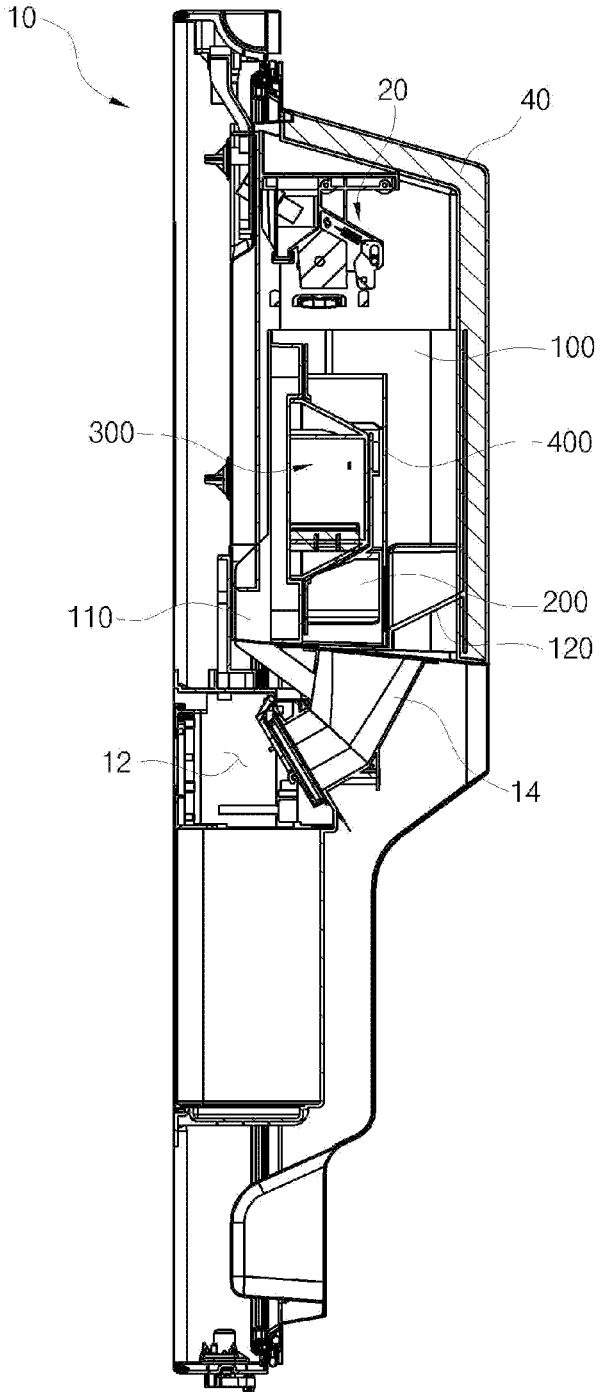
FIG. 4 is a side cross-sectional view illustrating an exemplary refrigerator door according to embodiments of the present disclosure.

FIGS. 2 and 3 are perspective views illustrating exemplary exterior and interior portions of a refrigerator door according to embodiments of the present disclosure. FIG. 4 is a side cross-sectional view illustrating an exemplary refrigerator door according to embodiments of the present disclosure. An ice maker that is provided at the refrigerator door will be described with reference to FIGS. 2 to 4.

Referring to FIG. 2, a refrigerator includes a cabinet (not illustrated) that forms a refrigerator chamber and a freezer for storing food, and doors 10, configured to open and close the refrigerator chamber and the freezer, and a dispenser 12 configured to dispense ice, is provided at the door 10, so that a user may obtain ice outside of the refrigerator.

Referring to FIG. 3, an ice maker 20, an ice bin 30, and/or the like are inside the door 10 to supply ice to the dispenser 12.

The ice maker 20 is inside the door 10, and is configured to produce ice with water cooled using cold air in the freezer. The ice bin 30 is at a lower side of the ice maker 20 to receive and store ice produced by the ice maker 20.

When describing a process in which the ice is produced inside the door 10 and is then dispensed outside of the door 10 in accordance with the present disclosure, referring to FIG. 4, first, the ice maker 20 at an inner upper portion of the a door 10, makes and/or produces ice with water supplied from an outside source (e.g., a tap water line) or an internal source (e.g., a water tank in the refrigerator compartment).

The ice produced by the ice maker 20 drops into a case 100 of an ice bin 30, and then is supplied to a transferring unit 200 through a dispensing (e.g., inclined) surface 120 having a downward slope toward one side.

The ice supplied to the transferring unit 200 is transferred to a crushing unit 300, and the ice may be crushed in various forms depending on the selection of the user. The ice crushed by the crushing unit 300 is discharged to the dispenser 12 through a dispensing port 110 at a lower and/or front side or surface of the case 100, and an ice chute 14 is configured to communicate with the dispensing port 110.

According to embodiments of the present disclosure, a heat insulating member 40 may be provided outside the ice maker 20 and the ice bin 30 to block cold air from being discharged to the outside when a user opens and closes the door 10.

Hereinafter, a specific structure constituting the ice bin 30 will be described in detail with reference to FIGS. 5 to 10.

Figure 5:
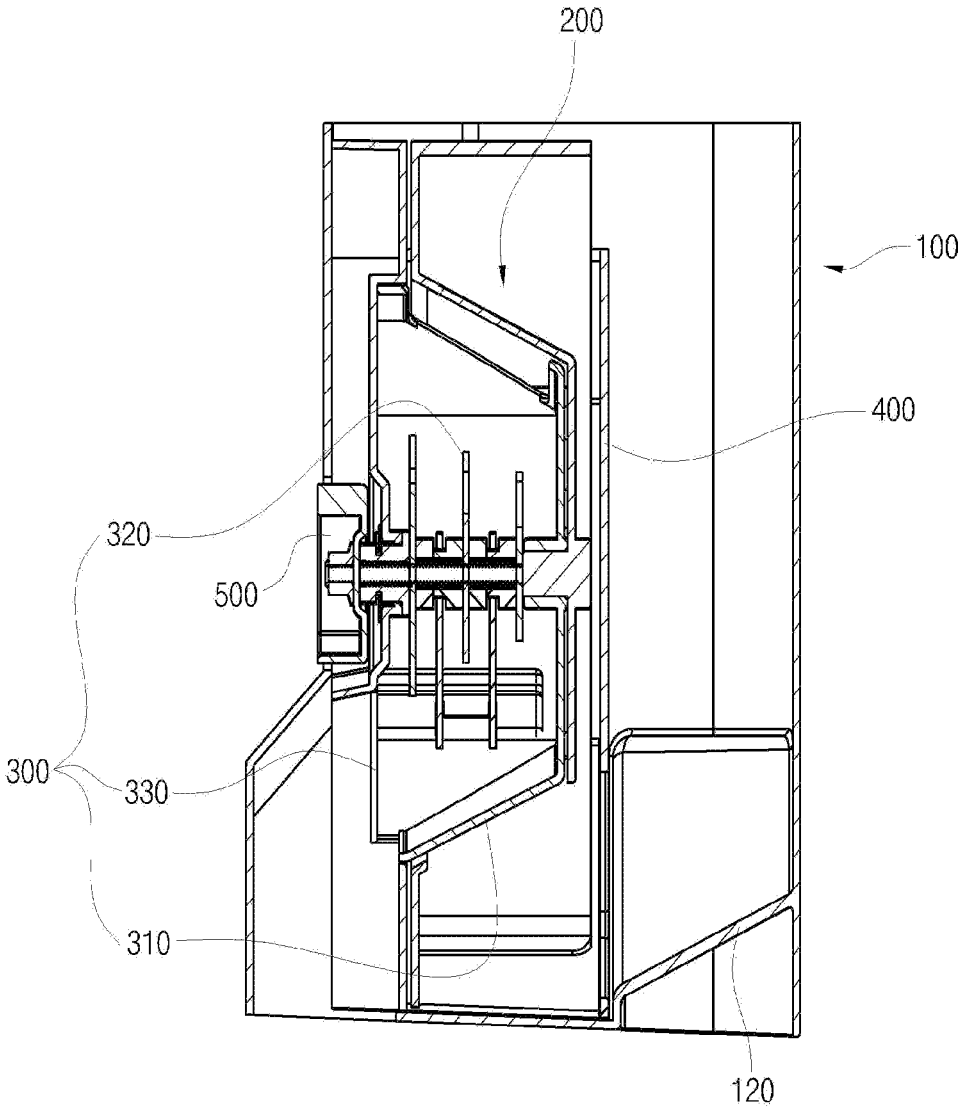
FIG. 5 is a side cross-sectional view illustrating an exemplary ice bin according to embodiments of the present disclosure.
Figure 6:
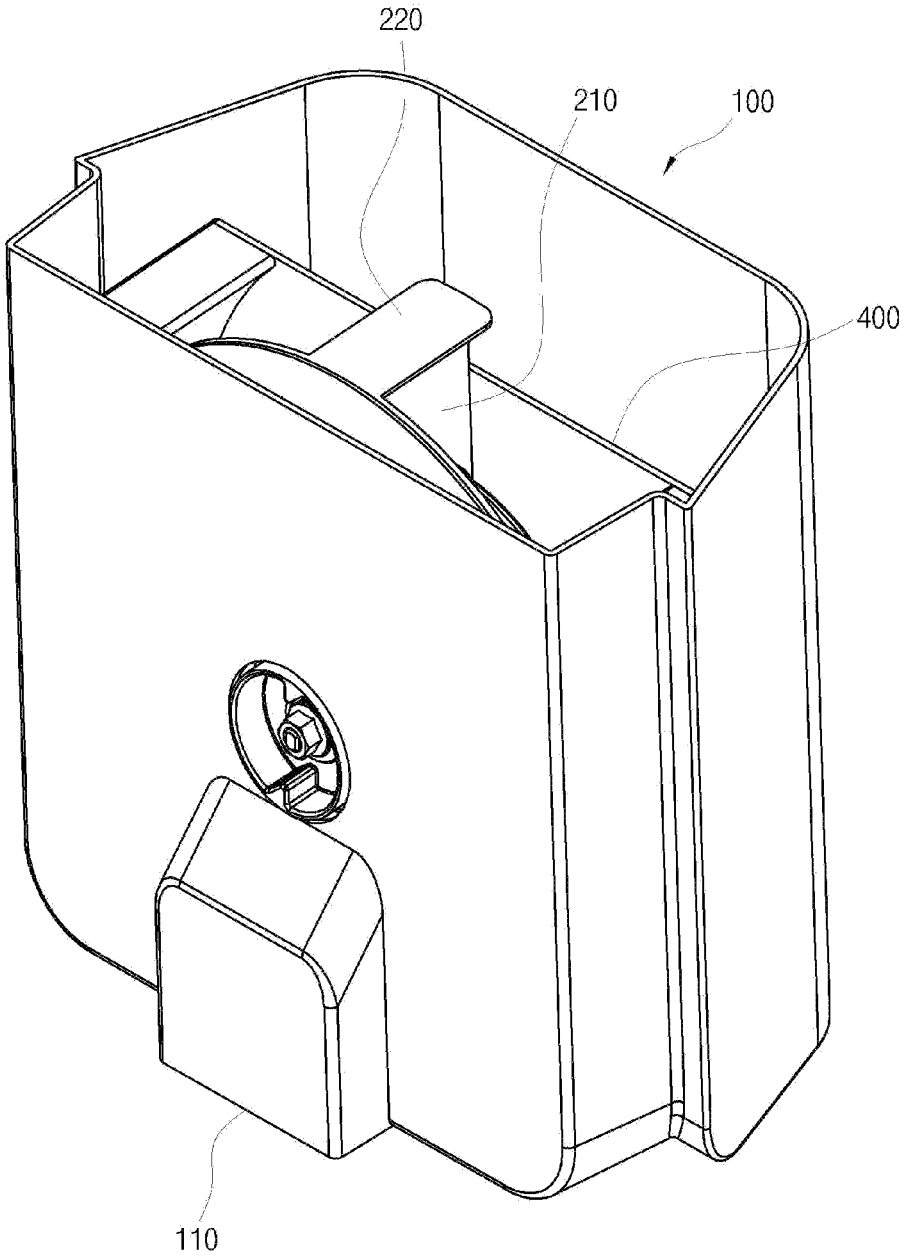
FIG. 6 is a perspective view illustrating one side of the exemplary ice bin according to embodiments of the present disclosure.
Figure 7:
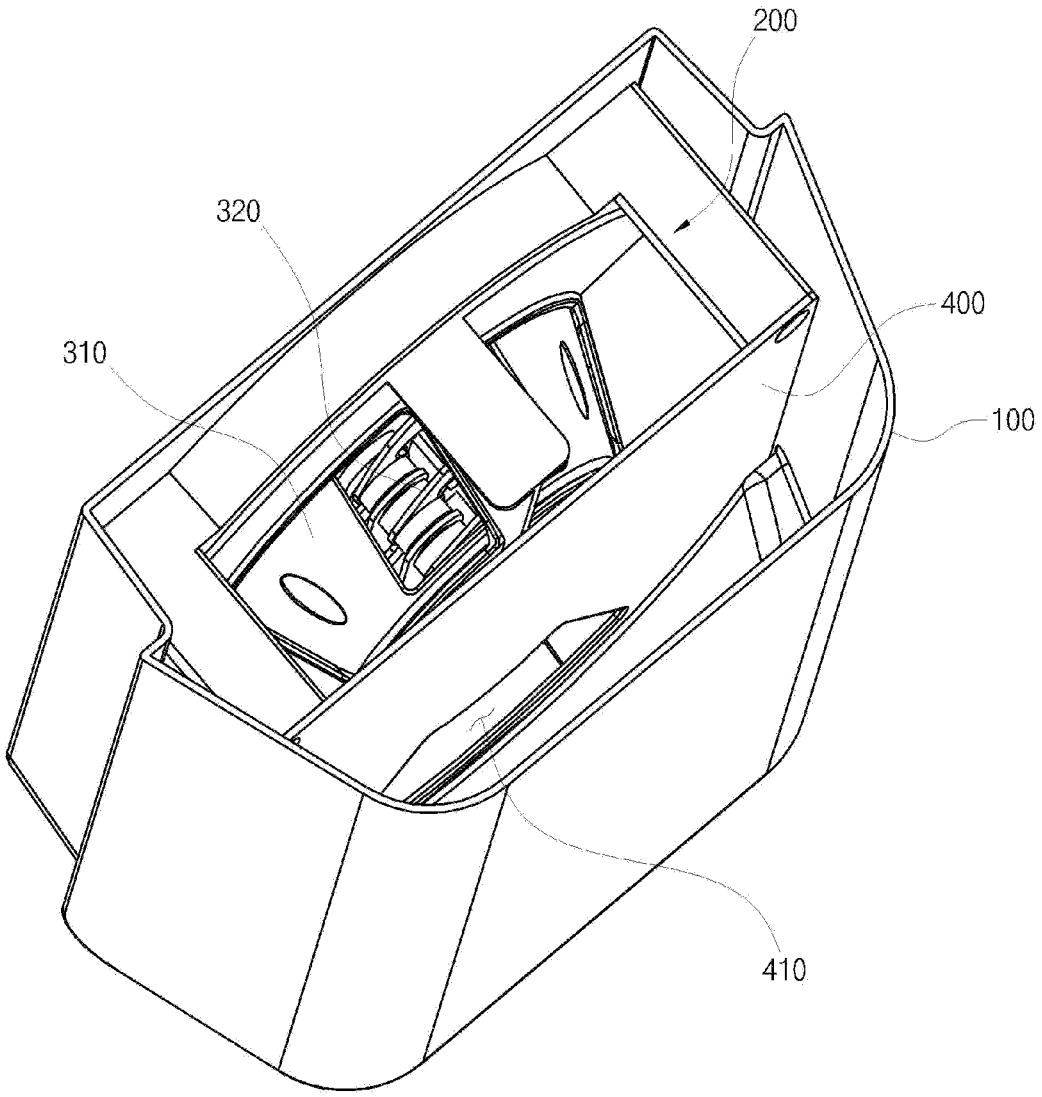
FIG. 7 is a perspective view illustrating another side of the exemplary ice bin according to embodiments of the present disclosure.

FIG. 5 is a side cross-sectional view illustrating the ice bin 30 according to embodiments of the present disclosure, and FIGS. 6 and 7 are perspective views illustrating one side and another side of the ice bin 30 according to embodiments of the present disclosure.

Referring to FIGS. 5 to 7, the ice bin 30 includes the case 100, the transferring unit 200, the crushing unit 300, a partition and/or wall 400, and a drive unit (e.g., motor) 500.

As described above, the case 100 stores the ice produced in the ice maker 20. An upper portion of the case 100 is opened to receive the ice that drops from the ice maker 20. The dispensing port 110 is at one side of a lower end surface of the case 100 to dispense the ice to the outside from the crushing unit 300. In one example, the dispensing port 110 is on a side and/or surface of the case 100 opposite from a gradient or declined surface of the dispensing surface 120.

The dispensing surface 120 is at the other side (e.g., the side connected to the gradient and/or declined surface) of the lower end surface of the case 100, and the dispensing surface 120 has a gradient or slope that declines downward toward the transferring unit 200, allowing the ice to drop from the ice maker 20, be stored in the case 100, and subsequently move toward the transferring unit 200.

The transferring unit 200 is at one side in the case 100, and is configured to transfer ice toward a transferring space in the case 100 along the dispensing surface 120 to the upper portion of the case 100.

Figure 9:
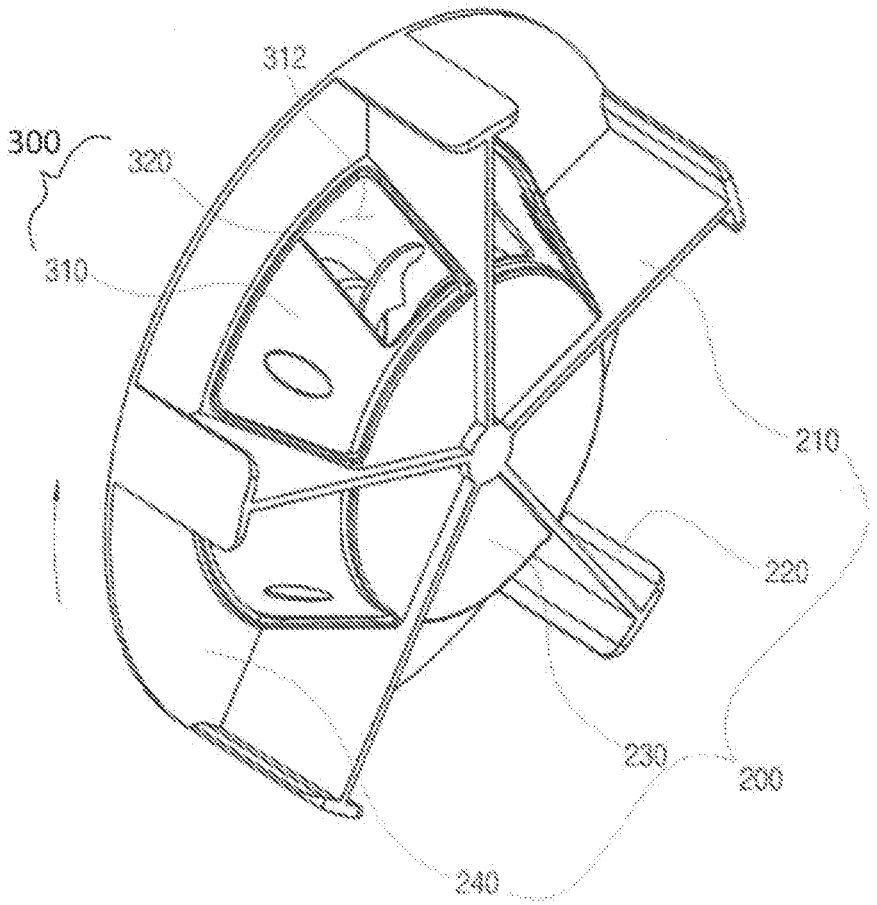
FIG. 9 is a perspective view illustrating an exemplary partition wall unit being removed from the case.

Referring to FIG. 9, the transferring unit 200 is outside the crushing unit 300, and includes a plurality of guide ribs 210, accommodating ribs 220, a first plate 230, and a second plate 240. The transferring unit 200 is configured to rotate (e.g., around the crushing unit 300), thereby moving the ice from the lower portion to the upper portion of the case 100.

In more detail, the plurality of guide ribs 210 rotate along an outer surface of the crushing housing 310 of the crushing unit 300 to move the ice to an upper portion of the case 100, and places the ice into an inlet port 312 of the crushing unit housing 310.

The plurality of guide ribs 210 may be rotatable in both directions, depending on a usage of the ice bin 30. As illustrated in FIG. 5, the drive unit 500 is provided on one surface of the case 100 and may comprise a motor that rotates the plurality of guide ribs 210 in both directions (e.g., clockwise and counterclockwise).

According to embodiments of the present disclosure, five guide ribs 210 are radially disposed around a rotation shaft. The number of guide ribs 210 may change or vary depending on the capacity of the storage space and/or the transferring unit in the ice bin 30, and the content of the present disclosure is not limited by the number of guide ribs 210.

Each of the accommodating ribs 220 is on an outer end or periphery of a corresponding one of the plurality of guide ribs 210, configured to prevent the ice from deviating from the transfer path (e.g., the path where the ice is transferred through the transferring unit to the crushing unit).

Since the plurality of guide ribs 210 may rotate in both directions depending on the usage, the accommodating ribs 220 maybe extended from the outer end of the guide rib 210 in both directions (e.g., clockwise and counterclockwise) by a predetermined length (e.g., 1 to 5 cm).

The first plate 230 has a circular or ring shape on one end or side of the crushing unit housing 310, and connected to one end edge or surface of each of the plurality of guide ribs 210.

The second plate 240 has an annular, ring or circular plate shape on another end or side (e.g., an opposite side) of the crushing unit housing 310, connected to an other end or surface of each of the plurality of guide ribs 210.

The first plate 230 and the second plate 240 are connected to opposite ends of each of the plurality of guide ribs 210 and/or along a common edge of the guide ribs 210, the first and second plates 230 and 240 to support the plurality of guide ribs 210.

According to embodiments of the present disclosure, the plurality of guide ribs 210, the accommodating ribs 220, the first plate 230, and the second plate 240 may be integrally formed (e.g., by molding using a single mold), without a separate coupling structure.

The ice that is transferred to the upper portion of the case 100 by the transferring unit 200 is placed into the crushing unit 300 and then crushed. Hereinafter, the crushing unit 300 will be described in detail.

Figure 10:
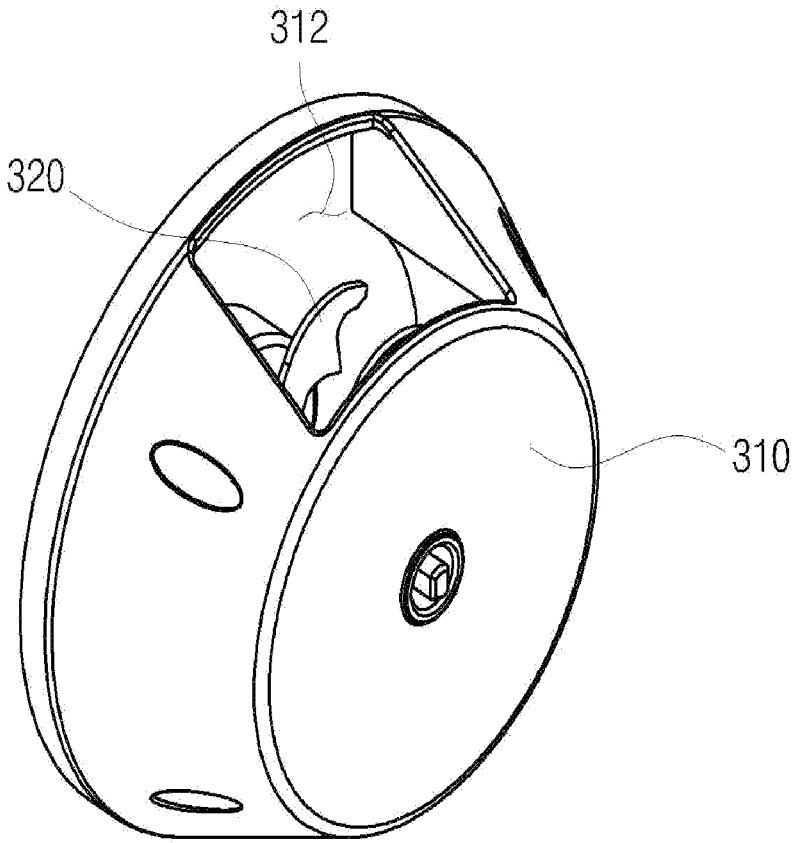
FIG. 10 is a perspective view illustrating an exemplary transferring unit being removed from the case.

Referring to FIG. 10, the crushing unit 300 includes a crushing unit housing 310, a crushing blade 320, and a cover 330 configured to open and close (see FIG. 5).

The crushing unit housing 310 is inside the transferring unit 200, and an inlet port 312 is at an upper side of the crushing unit housing 310, so that the ice that is transferred by the guide ribs 210 of the transferring unit 200, is placed into the crushing unit housing 310.

As illustrated in FIG. 10, the crushing unit housing 310 may have a conical and/or columnar shape, having one end, side, or surface with a greater diameter than another end, side, or surface, rather than having a typical cylindrical shape.

When the crushing unit housing 310 has a conical and/or columnar shape, a side surface of the crushing unit housing 310 declines downward toward the dispensing port 110 (see FIG. 4), so that the crushed ice may move to the dispensing port 110.

The rotatable crushing blade 320 is in the crushing housing and configured to crush the ice that enters through the inlet port 312. The rotatable crushing blade 320 is supplied with rotational drive force from the drive unit 500 at one side of the crushing unit housing 310.

The rotatable crushing blade 320 and the transferring unit 200 are rotated by the rotation shaft, such that the processes of transferring and crushing the ice may be simultaneously performed.

As described above, the drive unit 500 may comprise a motor configured to drive in multiple directions. When the guide rib 210 of the transferring unit 200 rotates in one direction, the rotatable crushing blade 320 rotates in the same direction, and when the guide rib 210 is rotated in the other direction, the crushing blade 320 is also rotated in the other direction.

The cover 330 opens and closes the outlet port which is at a lower (e.g., lowermost) side of one surface (e.g., the surface that declines toward the dispensing port) of the crushing unit housing 310, so that the interior of the crushing unit housing 310 communicates with the dispensing port 110.

According to embodiments of the present disclosure, the cover 330 closes the outlet port during the processes of transferring and crushing the ice, and opens the outlet port after the processes of transferring and crushing the ice, so to discharge the crushed ice through the dispensing port 110.

Figure 8:
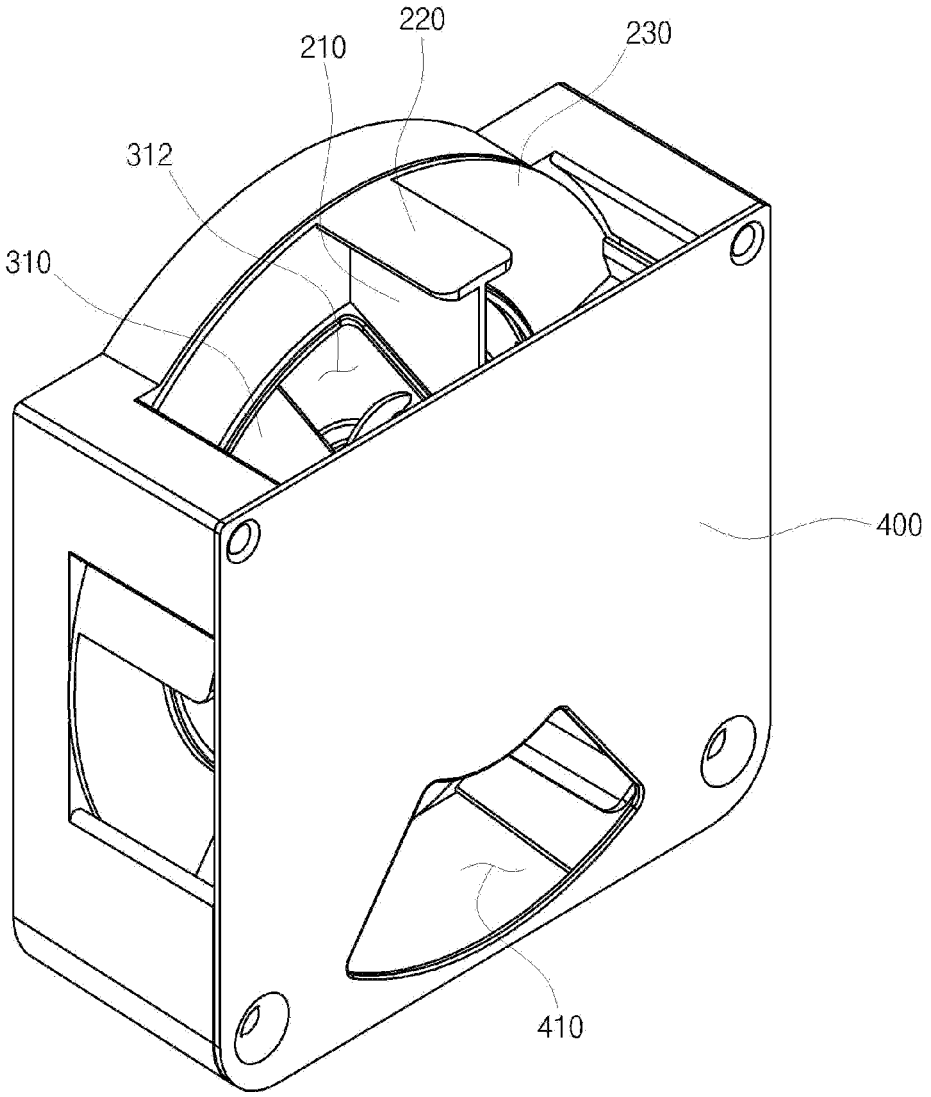
FIG. 8 is a perspective view illustrating an exemplary case being removed from the ice bin.

Referring to FIGS. 7 and 8, a partition and/or wall 400 is in the case 100, configured to divide the case 100 into spaces for storage and transferring the ice from the transferring unit 200 to the crushing unit 300.

The partition and/or wall 400 is configured to prevent ice from moving back into the case 100 when the ice is transferred by the transferring unit 200.

The ice drops and is placed into the ice bin 30 and stored in another side (e.g., the side along the transferring unit 200) in the case 100.

The ice stored in the case 100 moves to the partition and/or wall 400 by or along the dispensing surface 120, and then to the transferring unit 200 through a supply port 410 at a lower side of the partition and/or wall 400.

The ice that moves to the transferring unit 200, may be placed into the crushing unit 300 from the transferring space formed by the partition and/or wall 400.

Figure 11:
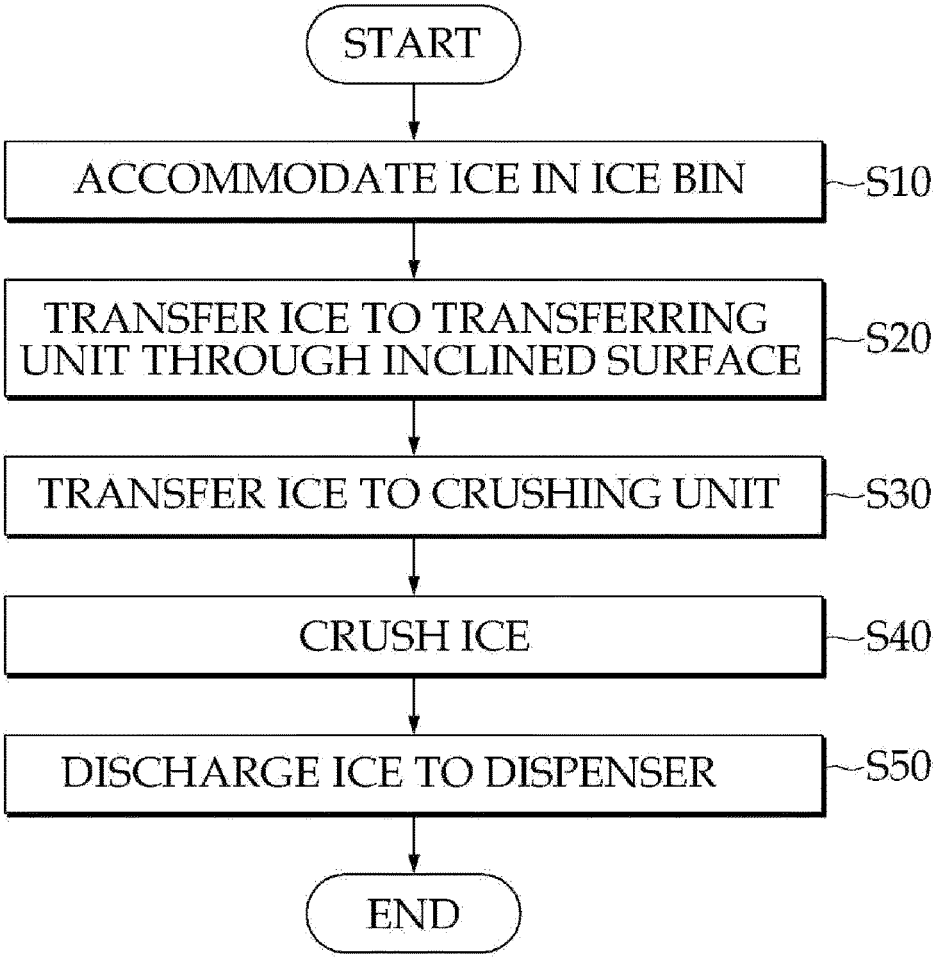
FIG. 11 is a flowchart illustrating an exemplary method of transferring ice using the ice bin according to embodiments of the present disclosure.

FIG. 11 is a flowchart illustrating an exemplary method of transferring ice using the ice bin according to embodiments of the present disclosure. The method of transferring ice will be described in detail with reference to FIG. 11.

First, the ice maker 20 is inside the door 10 and configured to produce ice with water cooled by using cold air in the freezer, and the produced ice drops and is stored in the ice bin 30 (illustrated as step SLY).

At step S10, the case 100 of the ice bin 30 has an upper portion, for storing ice produced by the ice maker 20.

When the ice is stored in the case 100, the ice is supplied to the transferring unit 200 along the dispensing surface 120 formed at the lower end and/or surface of the case 100 (illustrated as step S20).

At step S20, the lower end surface of the case 100 has a gradient or slope that declines toward the transferring unit 200 along the dispensing surface 120, such that the ice in the case 100 moves toward the transferring unit 200.

When the ice is supplied to the transferring unit 200, the ice can be transferred to the crushing unit 300 (as illustrated as step S30).

At step S30, the ice is supported and/or moved by the plurality of guide ribs 210 configured to rotate along the outer surface of the crushing unit 300, and placed into the inlet port 312 formed at the upper side of the crushing unit 300. The plurality of guide ribs 210 may rotate in both directions (e.g., clockwise and counterclockwise).

Furthermore, the accommodating ribs 220 at the ends of guide ribs 210 prevent ice from deviating from the path (e.g., where the ice is transferred from the transferring unit to the crushing unit) during the transfer to the crushing unit 300.

When the ice is transferred to the crushing unit 300 at step S30, the ice is crushed (illustrated as step S40) in the crushing unit housing 310 of the crushing unit 300.

After the ice is crushed, the crushed ice is discharged to the outside through the dispenser 12 provided outside the door 10 (illustrated as step S50), and the crushed ice moves toward the dispenser 12 through an ice chute 14 that communicates with the dispensing port 110.

Although exemplary embodiments of the present disclosure are described above with reference to the accompanying drawings, those skilled in the art would understand that the present disclosure may be implemented in various ways without changing the necessary features or the spirit of the present disclosure.

Therefore, it should be understood that the exemplary embodiments described above are not limitative, but only an example in all respects, the scope of the present disclosure is expressed by claims described below, not the detailed description, and it should be construed that all of changes and modifications achieved from the meanings and scope of claims and equivalent concept are included in the scope of the present disclosure.

From the foregoing, it will be appreciated that various embodiments of the present disclosure have been described herein for purposes of illustration, and that various modifications may be made without departing from the scope and spirit of the present disclosure. Accordingly, the various embodiments disclosed herein are not intended to be limiting, with the true scope and spirit being indicated by the following claims.

What is claimed is:

1. An ice bin comprising:

a case having a first portion configured to store and/or accommodate ice produced by an ice maker, and a dispensing port at one side of an end or surface of the case, configured to dispense the ice; and a transferring unit that transfers the ice from a second portion of the case to the first portion of the case, wherein the transferring unit includes a plurality of guide ribs that rotates along an outer surface of a crushing unit.

2. The ice bin of claim 1, further comprising:

a partition and/or wall in the case, configured to divide the case into a storage space and a transferring space.

3. The ice bin of claim 2, wherein the partition and/or wall has a supply port at a lower side of the partition and/or wall, configured to supply ice in the case to the transferring unit.

4. The ice bin of claim 1, wherein the end of the case has another side configured to slope downwardly toward the transferring unit.

5. The ice bin of claim 1, wherein the transferring unit further comprises one or more accommodating ribs, at a side and/or end of the plurality of guide ribs.

6. The ice bin of claim 5, wherein the transferring unit further comprises:

a first plate at one end or side of the crushing unit, connected to one end, edge or surface of each of the plurality of guide ribs; and a second plate on or at another end or side of the crushing unit, connected to another end or surface of each of the plurality of guide ribs.

7. The ice bin of claim 6, wherein the plurality of guide ribs, the accommodating ribs, the first plate, and the second plate are integral with each other.

8. The ice bin of claim 1, wherein the crushing unit comprises:

a housing having an inlet port at an upper side, configured to receive ice from the transferring unit; and a rotatable crushing blade in the housing, configured to crush the ice received in the housing.

9. The ice bin of claim 8, wherein the crushing unit further comprises a cover configured to open and close an outlet port.

10. The ice bin of claim 9, wherein the outlet port is at a lower side and/or (of one) surface of the crushing unit housing.

11. The ice bin of claim 10, wherein the housing is configured to communicate with the dispensing port.

12. The ice bin of claim 8, further comprising a drive unit at one side of the housing, configured to provide a driving force to a rotation shaft of the transferring unit and the crushing blade.

13. A method of transferring ice, comprising:

dropping ice produced by an ice maker into an ice bin;

supplying the ice from the ice bin to a transferring unit along a surface formed at a lower end of a case of the ice bin;

transferring the ice from the transferring unit to a crushing unit, crushing the ice transferred ice; and discharging the crushed ice through a dispenser, wherein the transferring the ice comprises moving the ice using a plurality of guide ribs that rotate along an outer surface of the crushing unit.

14. The method of claim 13, wherein the discharging the ice comprises discharging the crushed ice.

15. The method of claim 13, wherein the transferring the ice comprises placing the ice into an inlet port at an upper side of the crushing unit.

16. The method of claim 13, wherein transferring the ice further comprises preventing the ice from deviating from a path in the transferring unit using one or more accommodating ribs.

17. The method of claim 16, wherein the accommodating rib(s) are on ends of the plurality of the guide ribs.

18. The method of claim 15, wherein the plurality of guide ribs are rotatable in multiple directions.

19. The method of claim 18, wherein the plurality of guide ribs rotate clockwise or counterclockwise.

* * * * *